United States Patent [19]

Legrady

[11] Patent Number: 5,022,868

[45] Date of Patent: Jun. 11, 1991

[54] TORSION INSULATION DISPLACEMENT CONNECTOR

[75] Inventor: Janos Legrady, Putnam Valley, N.Y.

[73] Assignee: Zierick Manufacturing Corporation, Mt. Kisco, N.Y.

[21] Appl. No.: 458,142

[22] Filed: Dec. 28, 1989

[51] Int. Cl.[5] ..... H01R 4/24

[52] U.S. Cl. ..... 439/399

[58] Field of Search ..... 439/389–426

[56] References Cited

U.S. PATENT DOCUMENTS

| | | | |
|---|---|---|---|
| 3,854,114 | 12/1974 | Kloth et al. | 439/398 |
| 4,074,929 | 2/1978 | Krider | 439/398 |
| 4,116,522 | 9/1978 | Reynolds | 439/398 |

*Primary Examiner*—Joseph H. McGlynn

*Attorney, Agent, or Firm*—Brooks Haidt Haffner & Delahunty

[57] ABSTRACT

An insulation displacement connector (IDC) includes a pair of spaced, coextensive U-shaped beams fixed to each other along one pair of the beam portions of the beams in a mounting plane, the other pair of beam portions being free to move away from each in a contact plane in response to a wire and its insulation being forced into a wire-receiving channel or groove formed between the U-shaped beams. The IDC can be provided with mounting legs for mounting on a PC board, or on the body of a connector terminal. By curving at least one of the portions of the U-shaped beams a preset can be imparted to the contact of the IDC. The contacts can be shaped to receive a curve or cable, an electrical tab, a fuse or the like. When the IDC is used to terminate a wire or cable, it is preferably provided with a strain relief slot to minimize axial or longitudinaly forces of the wire or cable at the points where the insulation is displaced and electrical contact is made with the IDC. In use, separation of the contact beam portions creates torsional stresses in the IDC which act to secure the electrical component between the contact beam portions in an effective and reliable manner.

19 Claims, 6 Drawing Sheets

FIG.1
PRIOR ART
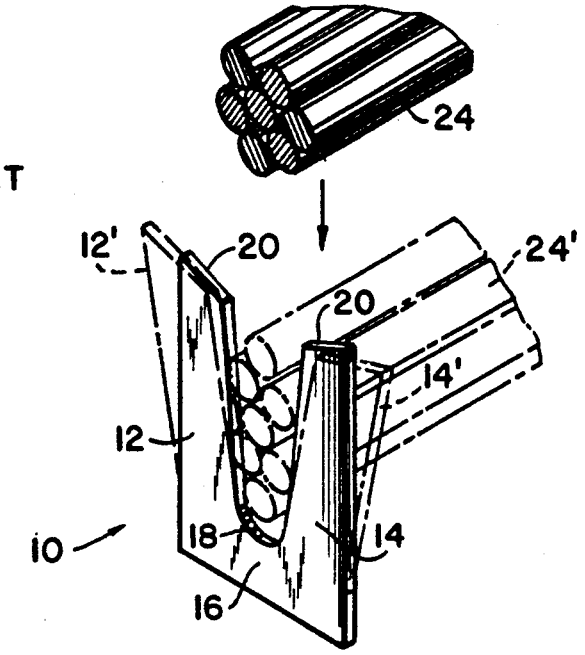
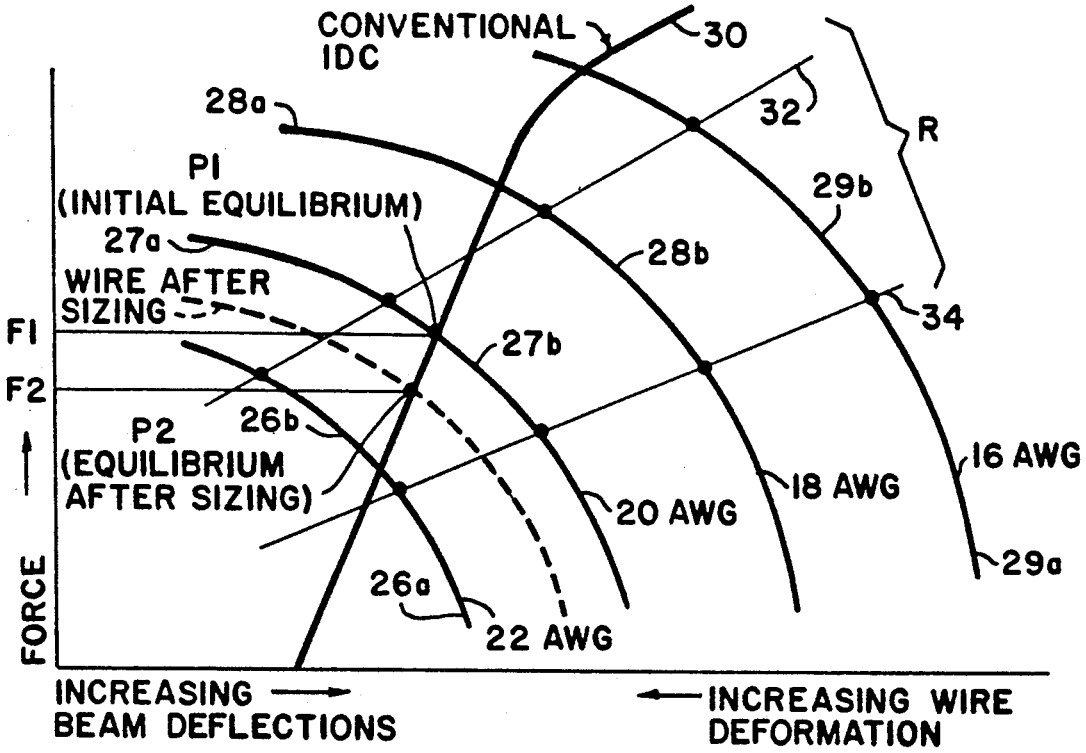
FIG.2
PRIOR ART

FIG.3
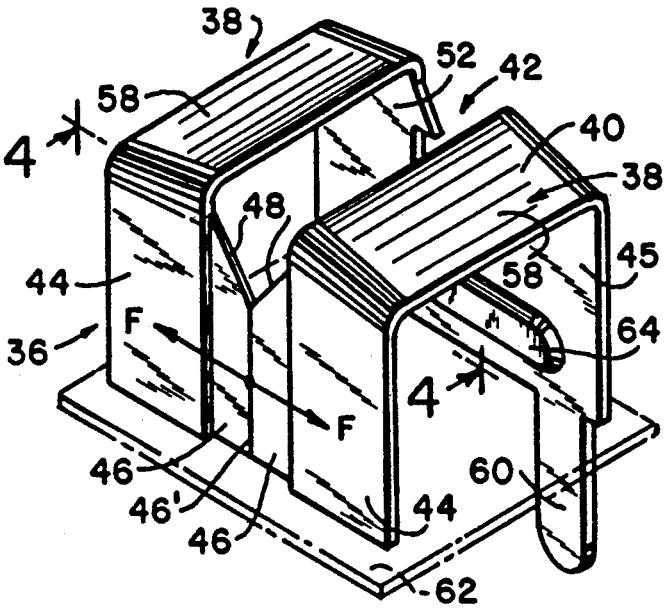
FIG.4
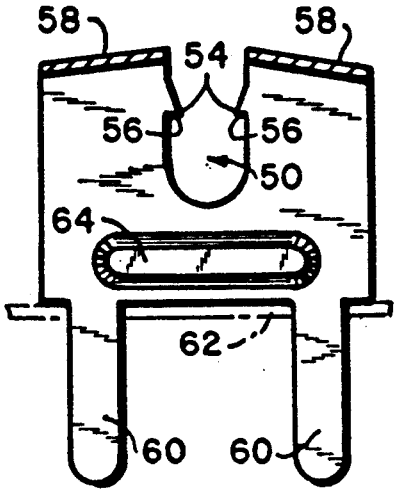
FIG.6
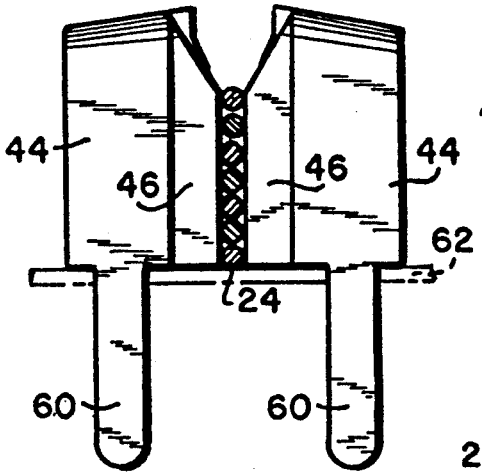
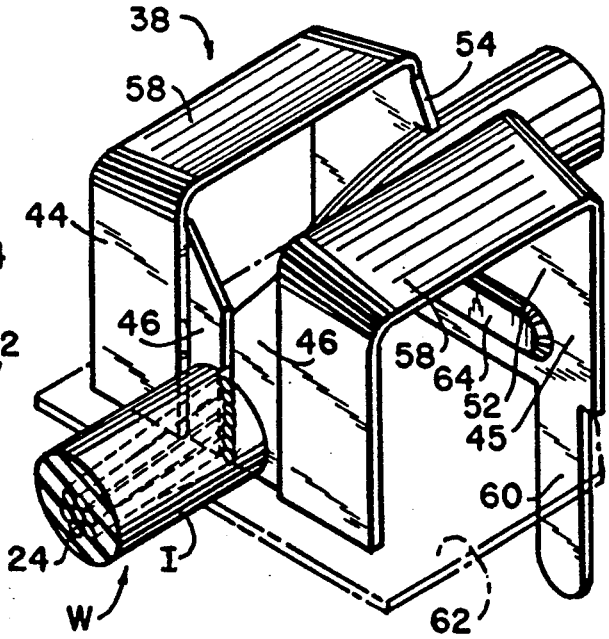
FIG.5

TORSION INSULATION DISPLACEMENT CONNECTOR

BACKGROUND OF THE INVENTION

1. Field Of The Invention

The invention generally relates to electrical connectors, and more specifically to insulation displacement connectors for printed circuit boards and the like.

2. Description Of The Prior Art

Insulation displacement connectors ("IDCs") have become popular since they are highly economical and a cost-effective method for performing wire terminations. No wire or cable preparation is required. IDCs are designed to reduce wire termination cost by eliminating the need to remove the insulation from the wire before terminating it. The connection to the wire is made by pushing it into a narrow slot or wire receiving channel between two fairly rigid contact beams or tines of the contact. The conductor slot is smaller than the conductor diameter. When a wire is inserted into the IDC slot, the lead-in chamfers cut and displaces the wire insulation. As the wire is pushed further down into the slot, there is a deformation of both the conductor and the IDC beam. The conductor will have mostly plastic deformation while the contact beams will have elastic deformation (deflect outwardly). Such deformation is proportional to the normal (contact force) which acts on the conductor and on the beam interface. This normal force is very important to establish and maintain a good gastight connection.

Several degrading mechanisms work against such gastight connection. The most significant factors include:

(a) creep which is the change in deflection or deformation over time with constant force. In the case of IDC termination, the wire creep is a significant factor. Also referred to as "sizing" which is defined as reduction of the wire diameter due to environmental conditions;

(b) Stress relaxation, which is the reduction in force over time with constant deflection. This factor largely depends on the initial stress level and the temperatures. Stress relaxation in the contact beams will reduce the normal force acting on the wire and/or its insulation;

(c) Movement between conductor and contact which is caused mainly by wire flexing, pulling, and the difference in thermal expansion coefficients of the conductor and the contact material. Those movements are especially degrading in the case of stranded wire because it helps the wire strands to rearrange in a narrower shape with lower energy level. Such movements can take place over time as external forces act upon the various strands and cause them to realign between the connector contacts.

All of the aforementioned degrading mechanisms cause normal (contact) force reduction, which depends on the contact spring rate. The short stiff beams of the conventional IDCs exhibit a high degree of rigidity and provide very little deflection. After wire sizing the contact force is largely reduced. Also, the stiff contact beams do a poor job in rearranging the wire strands into the narrowest width shape.

Numerous IDC designs have been proposed. U.S. Pat. Nos. 3,950,065; 3,937,549 and 4,074,929 disclose typical known IDC designs. It will be noted that many of these IDCs also provide strain relief by capturing the wire insulation and preventing longitudinal and other forces from acting on the conductors in the plane of the IDC contacts. Whether or not strain relief is provided, however, prior IDCs are formed as aforementioned, by a pair of spaced tines which are spaced to provide a wire receiving slot and are rigidly joined to each other at the closed end of the slot, thereby preventing movements of the tines relative to each other in the contact plane. Such design has imparted the undesirable stiffness or rigidity which has been discussed above.

SUMMARY OF THE INVENTION

Accordingly, it is an object of the present invention to provide an IDC design which eliminates the disadvantages inherent in prior IDC designs.

It is another object of the present invention to provide an IDC design which permits the contacts thereof a greater degree of movement relative to each other in the contact plane without exhibiting the stiffness or rigidity of known IDCs;

It is still another object of the present invention to provide an IDC which includes spaced longitudinal beams which define a wire receiving channel and which can be torsionally deformed in response to insertion of the wire into the wire receiving channel.

It is yet another object of the invention to provide an IDC which is simple in construction and economical to manufacture.

It is a further object of the invention to provide an IDC which is better suited to receive a range of wire sizes.

It is still a further object of the present invention to provide an IDC which is easy and convenient to use.

It is yet a further object of the invention to provide an IDC design which is reliable and substantially immune to the actions of external forces.

In order to achieve the above objects, as well as others which will become apparent hereafter, an insulation displacement connector for attachment to an insulation-covered wire comprises a pair of substantially coextensive U-shaped beams formed of flat sheet material and laterally spaced from each other to form a longitudinal wire-receiving channel. Each U-shaped beam has spaced substantially parallel contact and mounting beam portions and a transverse beam portion extending between and joining said mounting and contact beam portions. Said mounting beam portions of said pair of U-shaped beams being rigidly fixed to each other in a mounting plane to prevent relative movements which separate said mounting beam portions in said mounting plane. Said contact beam portions are spaced from each other a pre-determined distance in a contact plane which is substantially parallel to said mounting plane. Said contact beam portions are movable within said contact plane to separate said contact beam portions when a wire is placed into said wire-receiving channel. At least portions of said beams being torsionally deformable when a wire is placed within said wire-receiving channel and said contact beam portions are forced by the wire and its insulation to separate and thereby increase the spacing between said contact beam portions within said contact plane beyond said predetermined distance.

In accordance with various embodiments, said predetermined distance can be made either equal to zero or greater than zero. Additionally, when the pre-determined distance is equal to zero the contact beams may either be preloaded or simply abut against each other without preloading.

BRIEF DESCRIPTION OF THE DRAWINGS

These and other objects of the invention are achieved in preferred embodiments thereof which are described in greater detail below and which are shown in the accompanying drawings, in which:

FIG. 1 shows a typical wire strand rearrangement of a 7 strand wire before and after insertion into a conventional IDC;

FIG. 2 shows the spring rate of a conventional IDC contact and the force-deformation curve for different wire sizes;

FIG. 3 is a perspective view of a torsion IDC in accordance with the present invention, shown as would be mounted on a PC board before wire insertion;

FIG. 4 is a front elevational view of the IDC connector shown in FIG. 3, taken in cross-section along line 4—4 in FIG. 3;

FIG. 5 is a perspective view of the IDC shown in FIG. 3, after wire insertion;

FIG. 6 is a front elevational view of the IDC shown in FIG. 5, with the insulation removed to illustrate the rearrangement of the wire strands between the IDC contacts;

DESCRIPTION OF THE PREFERRED EMBODIMENTS

Figure 7:
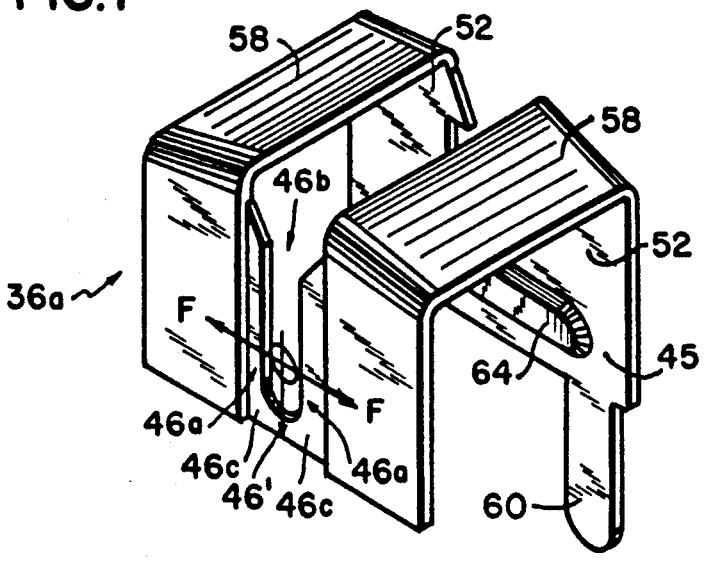
FIG. 7 is a perspective view similar to FIG. 3, but showing an alternate embodiment of the IDC wherein a groove or slot is formed in the contacts of the IDC which, nevertheless, continue to make contact at the lower ends thereof.

Referring now specifically to the figures, in which identical or similar parts have been designated by the same reference numerals throughout, and first referring to FIG. 1, a conventional IDC is generally designated by the reference numeral 10. As described in the previous section, conventional IDCs consist of two fairly rigid contact beams 12, 14 spaced from each other as shown and joined at one end by a base 16 to form a wire receiving slot 18. The contact beams 12,14 and the base 16 are typically die cut from a metallic plate or sheet material and are all located in a contact plane. The base 16 prevents significant movements of the contact beams 12,14 within the contact plane which separates the contact beams to significantly enlarge the size of the wire slot 18. The contact beams 12,14 are typically provided with inclined lead-in guide edges 20 and lead-in chamfers 22 to facilitate the insertion of a wire or wires 24 and maintain the same within the wire slot 18. Typically, the wire 24 consists either of a single conductor or includes a number of conductors which are stranded, a standard design 7-strand wire or conductor being shown in FIG. 1 without the insulator.

When the wire is inserted into the IDC slot 18, the lead-in chamfers 22 cut and displace the wire insulation (not shown) and, as the wire is pushed further into the slot 18, there is typically a deformation of both the conductors 24 and the contact beams 12,14. In FIG. 1, the stranded conductors 24 are shown to assume a generally aligned condition along the length direction of the slot 18 in order to conform therewith. The contact beams 12,14 are shown in phantom outline in expanded positions 12',14' as previously indicated, the conductors 24, in assuming positions 24', will have mostly a plastic deformation while the contact beams 12,14 will have elastic deformation and deflect outwardly. The contact beams 12,14, are generally rigid and are deflected very small amounts, this being exaggerated in FIG. 1 for purposes of illustration.

The degrading mechanisms which work against reliable contact and gastight connections have been described in the previous sections. All of these degrading mechanisms cause normal (contact) force reduction, this depending on the contact spring rate.

FIG. 2 shows the spring rate of a conventional IDC contact and the force-deformation curve for different wire sizes. The short, stiff beams of the conventional IDC have very little deflection. After wire sizing, the force is substantially reduced. Also, the stiff contact beams of the prior art IDCs have been largely ineffective in rearranging the wire strands into the narrowest width shape. This results in less contact area between the wire strands and the contacts of the IDC and therefore the connection exhibits higher contact resistance.

In FIG. 2, curves **26*a*–29*a* each represent the relative forces applied to wires of different sizes placed into an IDC slot. The curves 26*a*–29*a* represent wires of increasing size or diameter (e.g. 22AWG–16AWG). For any given curve 26*a*–29*a*, it will be noted that the force applied to the wire increases as the IDC slot decreases, and such force decreases as the IDC slot size increases. The deformation characteristics of a conventional IDC are designated by the reference numeral 30, the IDC applying zero force when undeflected and exhibiting a high deflection-force slope or ratio, the curve leveling off when the beams reach the limits of elastic deformation. It has been empirically determined that each of the wire curves 26*a*–29*a* includes a relatively small portion 26*b*–29*b*, respectively, which are considered as satisfactory ranges of deformation, these ranges defining lines 32 and 34 which bound the satisfactory wire deformation zone or range R. The actual force applied to the wire represented by the curve 27*a* when placed into the conventional IDC is determined by the point of intersection between the curves 27*a* and 30, or at equilibrium point P1 where force F1 is applied to the wire. However, the conductor or wire strands typically exhibit plastic deformation in time and this effectively reduces the size or external dimensions of the conductors or strands. This effect is sometimes referred to as "sizing", and the effect of sizing on one strand represented by curve 27a is shown in dashed outline in FIG. 2 by curve 27c. It will be noted that the entire curve 27a has moved towards the curve 26a representing a wire of higher gauge and, therefore, smaller external dimensions. The force applied to that same wire has decreased from F1 to F2 as the point of initial equilibrium P1 moves to equilibrium point P2 after sizing. It will be appreciated, therefore, that the effect of sizing on captured conductors or wires in a conventional IDC can be traumatic and the initial forces applied to the conductor or wires can drop substantially as a result of the high rigidity and, therefore, steep slope of the conventional IDC curve 30**. This is an undesirable effect since it can significantly reduce the forces acting upon the conductor or wires.

Referring now to FIGS. 3 and 4, a torsion IDC in accordance with the present invention will be described and is generally designated by the reference numeral 36. The torsion IDC (TIDC) 36 includes a pair of substantially co-extensive U-shaped beams 38, 40 formed of flat sheet material as shown and laterally spaced from each other to form a longitudinal wire receiving channel or space 42. Each U-shaped beam 38, 40 has a contact beam portion 44, both spaced or opposed contact beam portions being arranged in a common contact plane as shown. Spaced behind the contact beam portions 44, as viewed in FIG. 3, there is provided a back supporting portion or base 45 which is parallel to the contact plane and which itself defines a support or mounting plane. Each of the contact beam portions 44 is provided with a contact 46 which is arranged in the contact plane and which projects into the wire receiving channel 42 as shown. Each of the contacts 46 is provided with a lead-in guide or edge 48, the two edges 48 of opposing contacts 46 sloping downwardly and inwardly, as viewed in FIG. 3, to provide a V-shaped lead-in edge to facilitate insertion of a wire and promote displacement of its insulation.

The supporting portion or base 45 is shown to be provided with a strain relief slot 50, aligned with the wire receiving channel 42, to form rear torsion mounting beam portions 52 on each side of the strain relief slot 50. Clearly, the deeper the strain relief slot 50, the longer the mounting beam portions 52 are. The dimensions of the strain relief slot 50 are such as to receive a wire and its insulation without significant deformation or insulation displacement. However, the wire is received within the strain relief slot in pressure contact or abutment so as to resist or inhibit longitudinal or axial displacements of the wire. This, as with other IDCs, eliminates or minimizes the strains which are applied to the conductors themselves between the contacts 46. In order to prevent inadvertent movement of the wire out of the strain relief slot 50, there is advantageously provided inwardly directed lead in guide edges 54 which cut back normally to the edge of the slot so as to create inwardly directed barbs or hooks 56. Such barbs or hooks allow the wire to be placed or forced into the strain relief slot 50 but resists its movement out of the slot.

Extending between the front contact beam portions 44 and the rear mounting beam portions 52 are curved transverse top beam portions 58. The slight curvature of the transverse beam portions 58 is best shown in FIG. 4. Extending downwardly from the supporting portion or base 45, as viewed in FIGS. 3 and 4, are mounting legs 60 which are dimensioned to be received within mounting holes of a printed circuit board 62.

The various contact, mounting and transverse beam portions 46, 52 and 58, respectively, are all die cut or punched from flat sheet material, the U-shaped configuration being formed during separate bending steps. During the initial cutting operations, there is advantageously provided an elongate transverse depression 64 in the supporting portion or base 45 to enhance the rigidity and strength thereof.

Referring to FIGS. 4 and 5, there is shown a wire W which includes stranded conductors 24 and an insulation I. The wire W is shown forced between the contacts 46. The separation of the contacts 46 exerts certain opposing forces F (FIG. 3) on the contacts 46, and these forces torsionally deform the beam portions 44, 52 and 58. As a result of the ability of the IDC to torsionally deform the aforementioned beams, the IDC has improved flexibility and ability to sustain separation of the contacts 46 without plastic deformation. The torsional deformations within the beam portions act to resist the forces F and to urge the contacts 46 towards each other. Such restoring forces insure that the contacts 46 displace the insulation I and urge the individual strands of the wire into alignment with the separation line 46' between the contacts 46. In FIG. 6, the conductors 24' are shown rearranged in a single line along the direction of the slot formed between the contacts. Such realignment reduces the contact resistance between the conductors 24' and the IDC. Also, when the wires are rearranged in this manner this represents a condition of equalization for the wire strands and the IDC, and further relative movements are unlikely. However, these same restoring forces which urge the contacts 46 to move inwardly towards each other also have the effect of plastically deforming the conductors in a process which is sometimes referred to as "sizing", which effectively results in a reduction in certain external dimensions of the wire conductors 24', or individual strands thereof.

Referring to FIG. 7, a variant form of the IDC 36a is shown. Here, the contacts 46 have upper portions 46a reduced in size to form a contact slot 46b at the upper end of the contacts, while the lower ends of the contacts 46c are as in the previous embodiment. The contacts 46c also join at a separation line 46'. The IDC 36a is better suited for low wire gauges which have larger external dimensions thereby making it possible to accommodate such large wires without unduly damaging the conductors by applying excessive forces thereto.

The IDCs 36 and 36a exhibit high force, high deflection, and low stiffness. An important feature of the present invention is that the contacts 46, 46c may abut each other with zero force or may be urged against each other with a preset force called preload. Preload is set by forming the top torsion beam portions 58. Preload can also be set by slightly curving the rear mounting beam portions 52 and the rear supporting portion or base 45. With the proper preload, the minimum contact force, the range of the wire sizes, and even the wire strand rearrangement can be controlled effectively.

When a wire is pushed against the coined V-shaped insulation shear edges or lead-in-guide edges 48, the edges will cut the wire insulation. If the wire is pushed further between the contacts, the IDC slot will open up. This slot can be opened up to a width, larger than the wire diameter, without taking a permanent set, so that it can receive the total full diameter of the stranded wire. At this stage, the terminal beams are in a maximum force-maximum deflection position and exert high normal forces F on the wire. When the wire is moved further downward in the wire slot, the high normal forces F combined with the downward movement of the wire will rearrange the wire strands 24' into their narrowest shape, and in the case of a stranded wire, one single line (if the wire strands are not bundled too tightly). The front contact beam portions 44 will close in on the wire strands and keep them under contact pressure. The ability of the torsion IDC to achieve this large force, large deflection characteristic can best be explained by a stress analysis. When a force F is applied to the center of the two front contacts 46, as shown in FIG. 3, the two front contact beam portions 44 are under bending load. The top or transverse beam portions 58 are under a combined load of torsion and bending load and the mounting beam portions 52 are also on the torsion and bending load. The deflection of the wire is the sum of the angular deflection of the beams under torsion load and the beam deflection under bending load. Numerical analyses show that the deflection from the torsion load is much larger than the deflection from the bending load.

Figure 8:
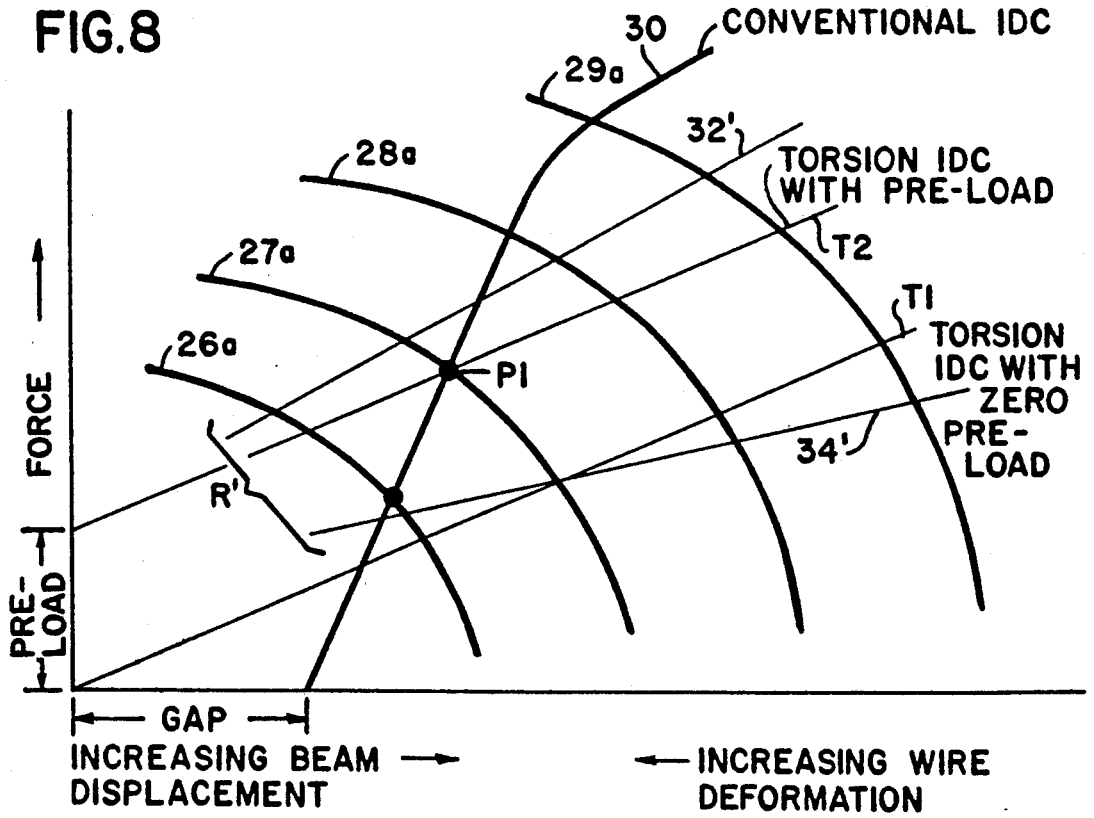
FIG. 8 shows the force-deflection diagram of a conventional IDC, the torsion IDC and the force-deformation curves for different wire sizes.

Referring to FIG. 8, a force-deflection diagram is shown for a conventional IDC, the torsion IDC and the force-deformation curves for different size wires. The points of intersection of such curves and the IDC curves represent equilibrium points. Since the preloads can be set independently (without changing the stiffness of the torsion IDC), the IDC torsion-deflection curve can be moved up or down so that it intersects the maximum number of different wire sizes in the satisfactory deformation range R. In FIG. 8, the torsion IDC with zero preload provides acceptable connection for only two wire sizes, represented by curves 28*a* and 29*a*. By increasing the preload as shown, the IDC can terminate five or more wire sizes. A terminal which has been produced by Zierick Manufacturing Corporation can terminate a range of wire sizes from 18 to 26 AWG. It will also be appreciated that because of the high slope exhibited by the conventional IDC, it will frequently terminate only one, or at most, two wire sizes.

Figure 9:
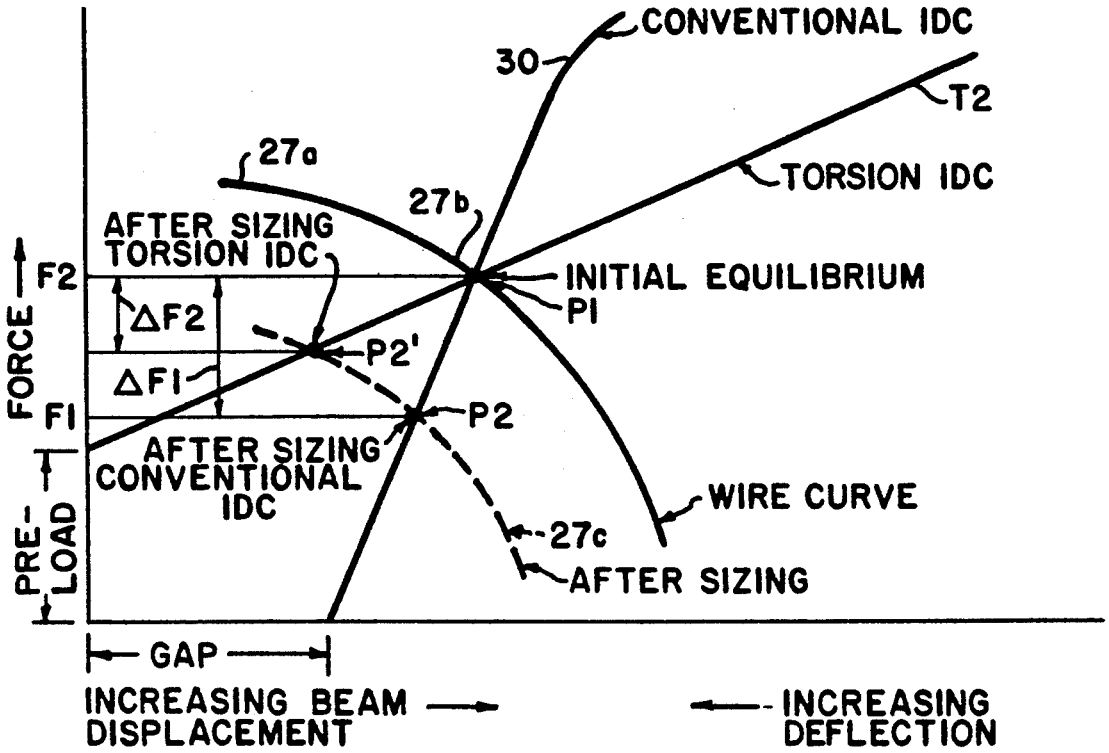
FIG. 9 shows the effect of conductor sizing or change in the width of the rearranged wire strands on the normal forces acting thereon.

Referring to FIG. 9, the effect of sizing is demonstrated. For the same sizing there is a greater change ( F1) in the normal force for the conventional IDC than for the torsion IDC. There is only a small change in the normal force ( F2) for the torsion IDC because of the low stiffness characteristics of the torsion IDC. Even at zero gap there is enough force to maintain a good gas-tight contact. The contact pressure can be set by the optimum combination of preload on the two front contacts 46 and by coining the edges of the contact beams to adjust the contact area. An important feature of the instant IDC is that the drop in normal forces applied to the wires changes much less dramatically than with conventional IDCs. This tendency to maintain normal contact forces on the wires is an important characteristic of the IDC which enhances its overall reliability even over extended periods of time and notwithstanding the influence of external forces.

Figure 10:
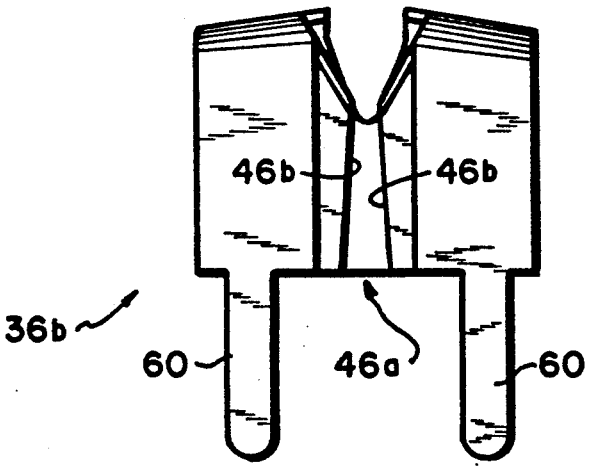
FIG. 10 is a front elevational view of a still further embodiment of the IDC in accordance with the present invention which has a slightly tapered wire conduit slot which widens at the lower part of the terminal when a wire is inserted (wire not shown)

In FIG. 10, there is shown another version of the torsion IDC 36*b*, wherein there is provided a tapered wire conduit or slot 46*a* which widens at the lower part of the terminal, as viewed in FIG. 10. The angle of the taper can be adjusted by setting the preload correctly. The preload is not uniform along the length of the wire conduit slot, it is larger near the insulation shear edges 48. A slightly tapered wire slot 46*a* improves the connector's reliability. If there is wire strand movement as a result of vibration or temperature change, the strands will move to the direction of least resistance, which is downward, as viewed in FIG. 10, where the slot is slightly wider. The lower end of the slot is closed off by the PC board 62 so the wire strands cannot leave the slot. When a wire is inserted into the terminal, the wire insertion force is increased to the maximum while the insulation is cut and the wire opens up the wire slot 46*a*. From this maximum level, the wire insertion force will rapidly decrease to a minimum while the wire is pushed down into the slot. This gives a snap-in effect. It is advantageous that when the wire is inserted with a hand tool (field termination) it gives a good feedback. Where the operator pushes the hand wire insertion tool with an increasing force, the wire does not move until the force reaches the termination force level. Then the wire just snaps all the way into the slot. Half way insertions are thereby avoided. On a conventional IDC terminal, the wire insertion effect is just the opposite. It takes an increasingly large force to push the wire all the way down into the wire slot because the wire gets tighter and tighter. Where there is wire movement from shock, thermal cycling, or vibration, the wire tends to move out of the slot because it moves in the direction of least resistance. The IDC in accordance with the present invention is not sensitive to the relative motion between the wire and the terminal.

The strain relief slot 50 on the back supporting portion or base 45 works well as a wire strain relief by holding the wire firmly in place. The two hooks, barbs or dimples 56 prevents the wire from coming out of the strain relief slot. Also, this strain relief slot with hooks simplifies wire insertion during assembly. The wire can be pushed in and seated in the strain relief slot 50 by hand. This keeps a section of the wire lined up with the V-groove typically provided on the insertion tool which terminates the wire by inserting it into the wire slot.

Figure 11:
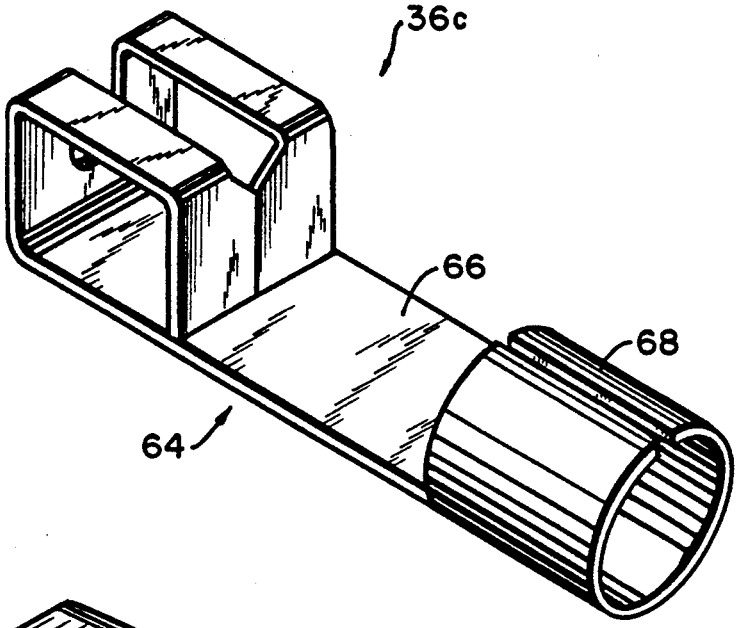
FIG. 11 is a perspective view of a terminal connector which embodies the IDC of the present invention.
Figure 12:
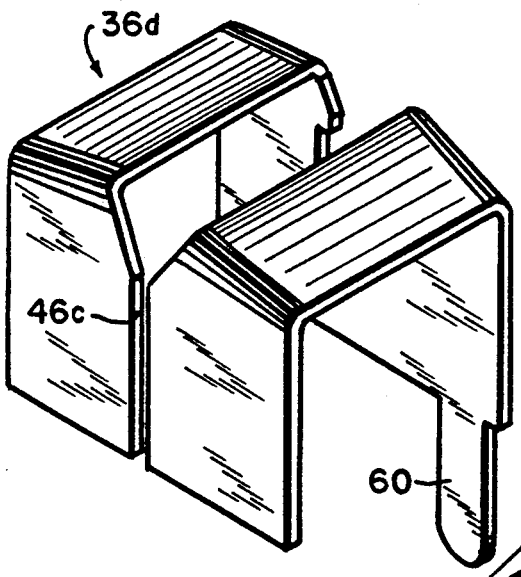
FIG. 12 is a perspective view of still another embodiment of the IDC of the present invention, wherein the contacts of the connector are separated to form a slot therebetween prior to insertion of a wire.
Figure 13:
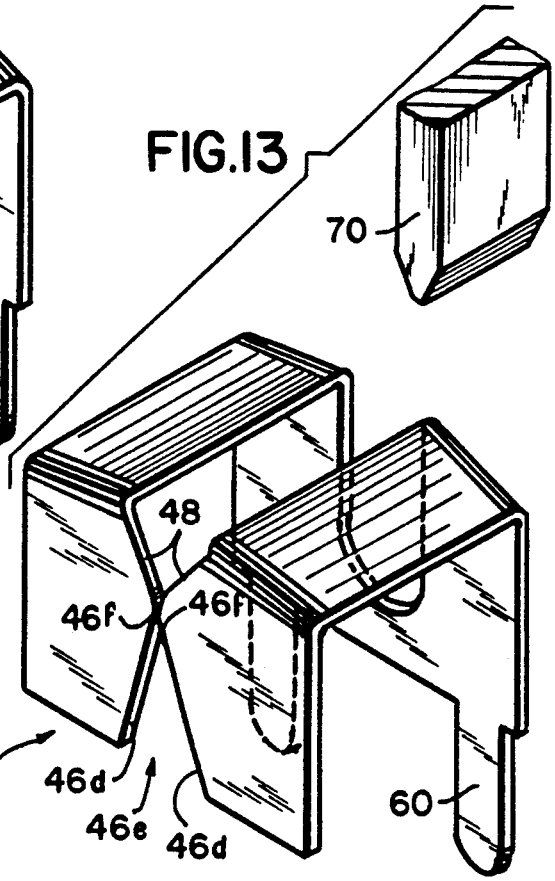
FIG. 13 is yet another embodiment of the invention, wherein the contacts are configurated for accepting a tab instead of a wire, and showing a portion of the tab prior to insertion.

While the embodiments 36,36*a* and 36*b* have been described in connection with a PC-board wire termination, the same or similar design principles can be used in connection with other wire terminations and other electrical applications involving the terminations of a wire or cable. Thus, referring to FIG. 11, while the lower end of the separation slot 46' or slot between the contacts 46 is normally closed by the PC board 62 when mounted thereon, it is also possible to use a terminal 64, wherein the terminal body 66 closes the separation line 46' at the end thereof opposite to the lead in guide edges 48. The IDC connector 36*c* of FIG. 11 includes a female receptacle 68 at the end of the terminal body 66 opposite from where the IDC structure is mounted. The IDC portion of the connector 36*c* operates in the way previously described in connection with IDCs 36,36*a* and 36*b*. Similarly, the same IDC terminal construction can mate not only with wire but with other electrical components. Referring to FIG. 12, it may not always be possible or practical to use a zero clearance wire slot (separation line 46') with larger wire sizes. Terminals designed for 14 AWG wire sizes and larger preferably have an open slot 46*c* between the contact beam portions 44. No preload is possible in this configuration, since the contact beam portions 44 do not abut against each other. However, the normal forces on the wire can be made high when the terminal can be made from a thicker material. Similar IDC constructions can be made which can mate not only with wire but also with tabs. Referring to FIG. 13, the high force-high deflection characteristic of the torsion design makes the terminal 36*e* very forgiving for misalignment, both angular and dimensional (misalignment). The IDC 36*e* is similar to IDC 36 of FIG. 3, except that diverging edges 46*d* are formed on each contact beam portion 44 to create an inverse V-shaped area and resulting point contacts 46*f* between the inclined edges on either side thereof.

Figure 14:
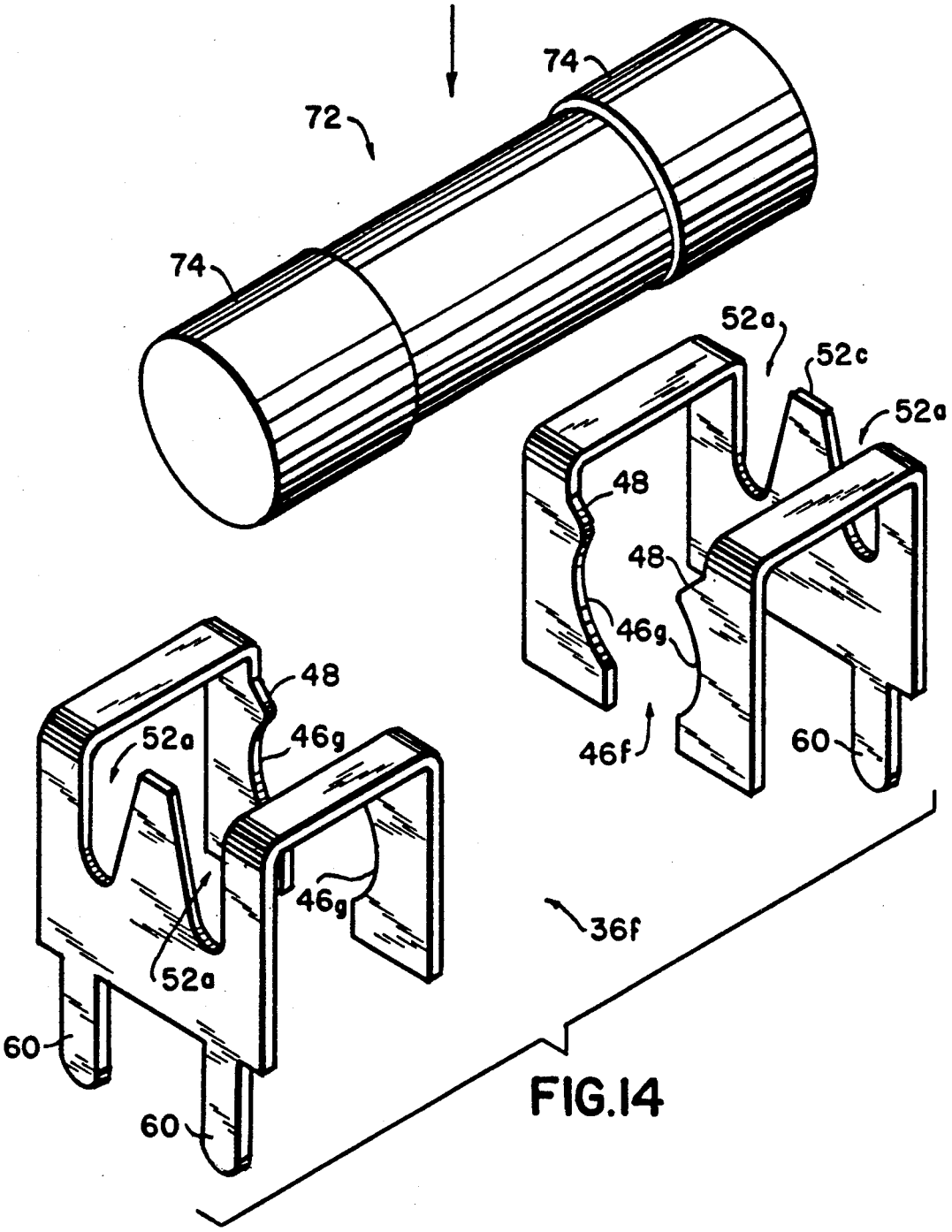
FIG. 14 is a perspective view of two spaced IDCs in accordance with the present invention, the contacts of which are configurated to receive a fuse, and showing a fuse prior to insertion into the IDCs which together form a fuse clip.

In FIG. 14, a low profile fuse clip is shown which utilizes the principles of the IDC construction in accordance with the invention, which takes advantage of the high deflection of the torsion design. Here, the contact beam portions 44 are provided with a circular receiving opening 46*f* created by the circular or curved edges 46*g* which are selected to have a diameter substantially corresponding to the fuse 72 cylindrical metallic caps or contacts 74. Since the IDC 36*f* is not used to terminate a wire, no strain relief slot is required. Instead, cut outs 52*a* may be provided and laterally spaced from each other in the back supporting portion or base 45 so as to create a resilient or flexible spring finger plate 52*c* which abuts against the metallic caps or contacts 74 when the fuse 72 is snapped into the IDCs to thereby prevent longitudinal movements of the fuse 72 and insure that the fuse remains within the fuse clip. The edges 46*g* are spaced from each other so as to abut against the metallic caps or contacts 74 in pressure relationship to insure good contact and low contact resistance.

The IDC terminal in accordance with the present invention is designed for a large range of wire sizes and dozens of mating cycles. A single terminal can accommodate a range from 18 to 28 AWG, while the maximum stress in the terminal remains below 70 percent of yield stress, so no permanent set and very little stress relaxation takes place.

Cross-sections of the terminations show wire deformation ranges of 15–40 percent depending on wire sizes. With stranded wire, the deformation range 5–15 percent. With 7 strand stranded wire most of the time the wire strands get rearranged into one single line, but not consistently because of other variables. When the wire is removed from the slot the terminal returns to its original zero gap position without the loss of the preload force between the contacts 46, which is sufficient to maintain a good contact. Contact resistance measurements before and after accelerated aging and temperature shock show less than 9 percent maximum change in contact resistance.

It should be understood that although preferred embodiments of the present invention have been illustrated and described, various modifications, alternatives and equivalents thereof will become apparent to those skilled in the art and, accordingly, the scope of the present invention should be defined only by the appended claims and equivalents thereof.

I claim:

1. An insulation displacement connector for attachment to an insulation covered wire comprising a pair of substantially co-extensive U-shaped beams formed of flat sheet material and laterally spaced from each other to form a longitudinal wire-receiving channel, each U-shaped beam having substantially parallel contact portions and mounting beam portions and a transverse beam portion extending between and joining said mounting and contact beam portions, said mounting beam portions of said U-shaped beams being rigidly fixed to each other in a mounting plane to prevent relative movements which separate said mounting beam portions in said mounting plane, said contact beam portions of said U-shaped beams being arranged a predetermined distance from each other in a contact plane which is substantially parallel to said mounting plane, said contact beam portions being movable within said contact plane to separate said contact beam portions when a wire is placed into said wire-receiving channel, at least portions of said transverse beams being torsionally deformable when a wire is placed within said wire-receiving channel and said contact beam portions are forced by the wire and its insulation to separate and thereby increase the spacing between said contact beam portions within said contact plane beyond said predetermined distance.

2. A connector as defined in claim 1, wherein said contact beam portions are spaced from each other a predetermined distance greater than zero prior to a wire being urged therebetween.

3. A connector as defined in claim 1, wherein the connector forms part of a wire terminal having a planar body portion joined to said mounting beam portions so that said contact beam portions are in close proximity to said planar body portion.

4. A connector as defined in claim 1, wherein said contact beam portions are configurated to form point contacts adapted to securely receive an electrical tab.

5. A connector as defined in claim 1, wherein a pair of connectors are provided which can be spaced from each other on a printed circuit board along a predetermined direction a distance corresponding to the length of a fuse to be mounted which has cylindrical end contacts, said contact beam portions of the two connectors being adapted to be mounted facing each other and being generally aligned along said predetermined direction, the contact beam portions on each connector defining a circular opening to receive a cylindrical contact of a fuse in pressure relationship.

6. A connector as defined in claim 1, wherein said contact beam portions are tapered to increase the width of a slot formed between said contact beam portions in the direction from said transverse beam portions.

7. A connector as defined in claim 1, wherein said contact beam portions are spaced from each other a predetermined distance equal to zero thereby abutting against each other prior to a wire being urged therebetween.

8. A connector as defined in claim 7, wherein said contact beam portions abut against each other without being pre-loaded.

9. A connector as defined in claim 7, wherein said contact beam portions abut against each other with a predetermined pre-loaded force.

10. A connector as defined in claim 1, wherein said mounting beam portions are joined to each other by means of a supporting portion in said mounting plane at the ends of said mounting beam portions remote from said transverse beam portions.

11. A connector as defined in claim 10, comprising strain relief means for engaging insulation of a wire placed with said wire-receiving channel to thereby relieve stresses and strains primarily in the longitudinal direction on the portions on the wire secured by said contact beam portions.

12. A connector as defined in claim 11, wherein said strain relief means comprises a strain relief slot in said supporting portion aligned with said wire-receiving channel and dimensioned to receive the wire and its insulation.

13. A connector as defined in claim 12, further comprising barbs inwardly directed into said strain relief slot to longitudinally secure the insulation of the wire.

14. A connector as defined in claim 10, wherein the connector is to be mounted on a printed circuit board having mounting holes, and further comprising at least one mounting leg extending from said supporting portion in said mounting plane in a direction opposite to the location of said transverse beam portions and dimensioned to be received within the mounting holes.

15. A connector as defined in claim 14, wherein said beam portions are dimensioned so that when the connector is mounted on a printed circuit board the ends of said contact beam portions remote from said transverse beam portions are in close proximity to the surface of the printed circuit board.

16. A connector as defined in claim 1, wherein at least one of said beam portions of each U-shaped beam is curved.

17. A connector as defined in claim 16, wherein said transverse beam portions are curved to provide a preset force acting between said contact beam portions.

18. A connector as defined in claim 1, wherein an enlarged slot aligned with said wire-receiving channel is formed in said contact beam portions which has a length less than the length of said contact beam portions to open in the direction of said transverse beam portions and being proximate to each other at the closed end of said enlarged slot.

19. A connector as defined in claim 18, wherein said contact beam portions abut against each other at the closed end of said enlarged slot.

* * * * *